United States Patent [19]

Jeschke et al.

[11] 4,101,122

[45] Jul. 18, 1978

[54] SHEET TURN-OVER DEVICE FOR A FIRST-FORM PRINTING AND PERFECTING PRESS WITH CLAMPING GRIPPERS

[75] Inventors: Willi Jeschke, Heidelberg; Arno Wirz, Bannental, both of Germany

[73] Assignee: Heidelberger Druckmaschinen Aktiengesellschaft, Heidelberg, Germany

[21] Appl. No.: 648,913

[22] Filed: Jan. 14, 1976

Related U.S. Application Data

[63] Continuation of Ser. No. 562,824, Mar. 28, 1975, abandoned.

[30] Foreign Application Priority Data

Mar. 28, 1974 [DE] Fed. Rep. of Germany ..... 2414998

[51] Int. Cl.[2] ..... B41F 21/04

[52] U.S. Cl. ..... 271/277; 271/82; 101/231; 101/410

[58] Field of Search ..... 271/82, 184, 185, 277, 271/85, 204; 101/231, 232, 409, 410

[56] References Cited

U.S. PATENT DOCUMENTS

| | | | |
|---|---|---|---|
| 2,757,610 | 8/1956 | Gegenheimer et al. | 271/82 |
| 3,430,946 | 3/1969 | Siebke | 271/277 |
| 3,747,920 | 7/1973 | Linkus | 271/85 |
| 3,796,154 | 3/1974 | Weisgerber | 271/277 |
| 3,899,970 | 8/1975 | Jurny | 101/409 |

FOREIGN PATENT DOCUMENTS

| | | | |
|---|---|---|---|
| 664,330 | 6/1963 | Canada | 271/204 |
| 340,667 | 7/1904 | France. | |
| 536,453 | 2/1932 | Fed. Rep. of Germany | 271/277 |

*Primary Examiner*—Robert W. Saifer
*Attorney, Agent, or Firm*—Herbert L. Lerner

[57] ABSTRACT

Sheet turn-over device for a one-side printing and perfecting press with clamping grippers pivotable about a rotary axis and mounted in a sheet turn-over cylinder so as to be adjustable from single-side printing to one-side printing and perfecting includes a gripper shaft coextensive with the rotary axis about which the clamping grippers are pivotable, a gripper tube coaxially disposed on the gripper shaft and separate control means for respectively driving the gripper shaft and the gripper tube. The rotary axis of the gripper shaft as well as of the gripper tube have a location radially inward from a point on a tangent to the periphery of the sheet turn-over cylinder at the point of clamping contact of the grippers.

7 Claims, 12 Drawing Figures

Fig. 5
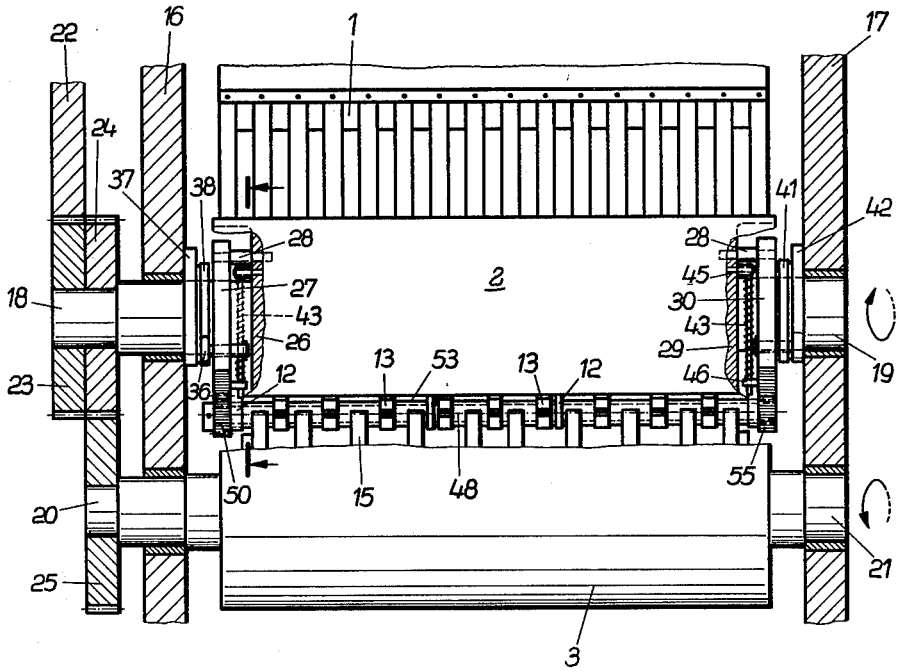
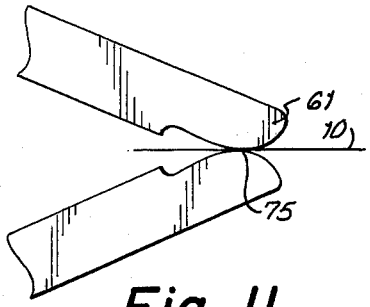
Fig. 11
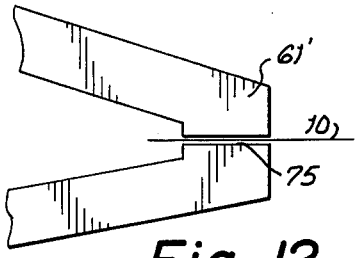
Fig. 12

SHEET TURN-OVER DEVICE FOR A FIRST-FORM PRINTING AND PERFECTING PRESS WITH CLAMPING GRIPPERS

This is a continuation application of application Ser. No. 562,824, filed Mar. 28, 1975, now abandoned.

The invention relates to a turn-over drive for a first-form or one-side sheet printing and perfecting press with clamping grippers that are mounted in a sheet turn-over cylinder and are pivotable about a rotary axis as well as convertible from single-side sheet printing alone to both one-side printing and perfecting.

It is an object of the invention to achieve sheet transfer from one printing mechanism to another without loss of registration both for single-side sheet printing alone as well as for one-side sheet printing and perfecting. To this end, only one sheet acceptance and one sheet delivery per transfer cylinder should take place between the printing mechanisms. Obviously, only clamping grippers are practical for this purpose.

In German Pat. No. 536,453, a sheet turning device disposed between two printing stations is described, which, heretofore, makes use of pivotable clamping grippers. These clamping grippers seize the sheet at the rear edge thereof, after it has received a first or single-side imprint, and feed it, turned-over, to the perfecting station. In order to assure reliable guidance of the sheet during the transfer operation, blower devices are provided in the vicinity of the transfer cylinders. The rotary axis of the gripper clamps is situated very deeply within the sheet-turning cylinder, so that severe bending of the rear edge of the sheet is unavoidable. Sheet transfer without loss of registration is therefore very questionable with such a location of the rotary axis. German Pat. No. 536,453 also lacks any mention therein with respect to suitable control means for and specific construction of the clamping grippers.

From the German Published Non-prosecuted Application DT-OS No. 1 810 589 a drive for clamping grippers of a sheet turn-over device in rotary printing presses is known, which can be adjusted at will from one-side printing and perfecting to single-side two-color printing. The rotary axis of the clamping grippers, that is made up of two equal halves, is situated outside the sheet turn-over cylinder. The clamping grippers are opened and closed by means of a square shaft which is disposed parallel to the gripper shaft and between jaws of the gripper clamps that have a mouth-like appearance.

According to German Published Non-prosecution Application DT-OS No. 1 810 589, the clamping grippers are pivoted by means of a gear which is mounted on the gripper shaft and is driven by a gear segment. The gear segment forms part of a rectangular linkage system actuatable by cams, the cam follower being adjustable to cooperate with two different cams.

The heretofore known driving device for clamping grippers has several disadvantages. Thus, for example, control of the clamping grippers by a rectangular bar does not permit any adjustment of the individual grippers which, however, would be absolutely necessary for obtaining proper registration. Furthermore, the mounting of the grippers is displaced relative to the contact surface, which invariably brings about one-sided wear. It is particularly disadvantageous, however, that the mounting of the gripper shaft is fixed a considerable distance outside the periphery of the sheet turn-over cylinder. This causes deep penetration of the bearings and the clamping grippers into the channel of the adjacent impression or transfer cylinder or drum. Strong and solid construction of the grippers, the gripper shaft and its mounting, which is necessary for obtaining proper registration, is impossible to obtain, particularly if the cylinder periphery is to be utilized as much as may be possible and, therefore, the channel is made quite small. Furthermore, this location of the rotary axis of the gripper shaft always produces a considerably larger pivot angle of the clamping grippers than if the rotary axis were located within the periphery of the sheet turn-over cylinder. Consequently, the aforementioned heretofore known device is highly subject to wear.

Another sheet turn-over device with clamping grippers has been disclosed in German Published Non-prosecuted Application DT-OS No. 2 224 218. It is convertible or adjustable from single-side printing to one-side printing and perfecting. The clamping grippers are disposed on a gripper shaft, one gripper being fixed and the gripper opposite thereto pivotable. The pivotable opposing grippers are provided with control fingers on which rollers of control levers are mounted, which are fastened adjustably by a clamp connection on a control shaft extending parallel to the gripper shaft. The rotary axis of the gripper shaft is located outside the periphery of the sheet turn-over cylinder.

The last mentioned, heretofore known turn-over device also has a number of intrinsic drawbacks. For example, the clamping grippers are inadequately adjustable and sprung on an individual basis, because the opening and closing of the grippers are controlled through the individual spring loading. It is therefore completely uncertain whether or not all the clamping grippers will hold the sheet with the same holding force in spite of the possibility of adjusting the control levers. The control of the opposing grippers through control levers disposed on a separate control shaft, and the rollers of those control levers is also disadvantageous, because these members would apparently be subjected to considerable wear. Moreover, control levers and rollers can be the cause of shocks and vibrations, which would have a detrimental effect upon the quality of the printing. In addition, here, too, the gripper contact surface and the stop are laterally displaced, which leads to canting or tilting. Furthermore, the height of the grippers is unequal due to small deviations of the control fingers one from another.

The intentional disposition of the rotary axis of the gripper shaft outside the periphery of the sheet turn-over drum indicates a limitation in the possible constructions of all the clamping gripper mounting and control members with respect to their stability. Furthermore, the large pivot angle of the clamping grippers limits the maximum machine speed to an unnecessarily low value.

It is accordingly an object of the invention to provide a sheet turn-over device of limited wear which permits sheet transfer at high printing speeds without loss of registration by relatively simple means.

It is further an object of the invention to provide gripper clamps, gripper shaft and corresponding bearings of stable construction, avoiding harmful bending of the sheets.

It is an additional object of the invention to provide the clamping grippers with equal holding force and with a relatively simple adjustability for simultaneous closing and opening.

It is yet another object of the invention to provide clamping grippers which, when swinging or pivoting from the single-side printing position to perfecting position, describes an angle that is as small as possible.

With the foregoing and other objects in view, there is provided in accordance with the invention, a sheet turn-over device for a one-side printing and perfecting press with clamping grippers pivotable about a rotary axis and mounted in a sheet turn-over cylinder so as to be adjustable from single-side printing to one-side printing and perfecting comprising a gripper shaft coextensive with the rotary axis about which the clamping grippers are pivotable, a gripper tube coaxially disposed on said gripper shaft, and separate control means for respectively driving the gripper shaft and the gripper tube, the rotary axis of the gripper shaft as well as of the gripper tube having a location deviating from a theoretically required location on a tangent to the periphery of the sheet turn-over cylinder.

In accordance with a preferred embodiment of the invention the clamping grippers have substantially spherically shaped clamping surfaces, the sphericity of which depends upon the location of the rotary axis. The possibility of providing the common rotary axis of the gripper shaft and the gripper tube at any selected location below the tangent to the peripheral line of the sheet turn-over cylinder opens the way for optimizing all of the partial objectives. For example, the rotary axis can be provided at a location where adequate stability as well as adequately reliable holding or retaining force of the clamping grippers is attainable without any possibility of occurrence of a bend in the edge of the sheet, which is detrimental to the maintenance of registry.

The mere fact that the sheet edge gripped by the clamping grippers becomes bent already implies intrinsically a danger of transfer without maintaining registration. In addition, the edge of the sheet can be deformed permanently which, in subsequent sheet transfers, may lead to the situation that grippers will strike against the bent sheet edge and will either damage it or at least deform it further, so that the errors in registration will be additive as the sheets are transported through several stations.

The construction of the mounting and control members or components of the clamping grippers as a coaxially disposed gripper shaft and gripper tube produces a compact, space-saving and stable structure of minimal susceptibility to vibration. Both gripper groups are individually controlled and can therefore be adjusted to the oncoming sheet edge independently of one another during the sheet transfer. It is therefore impossible for the front edge of the sheet to flip over or to get damaged. The separate control furthermore ensures the best possible utilization of the kinematic factors, so that a control process consuming little power can be obtained because the load variations are small.

In accordance with another feature of the invention, the sheet turn-over device includes respective gripper housings rotatably mounted on the gripper tube, the clamping grippers comprising respective first gripper members firmly secured to the gripper shaft, and respective second gripper members firmly secured to the respective gripper housing a stop member firmly mounted on the gripper tube for each of the second gripper members, the first and second gripper members, in the single-side printing position of the sheet turn-over device, being located at the outside and the inside respectively, of the periphery of the sheet turn-over cylinder adjustable limit means spaced from the stop member, the gripper housing respectively being rotatable in direction toward the stop against the biasing action of a compressive spring for closing the clamping grippers and being rotatable in direction toward the adjustable limit means for opening the clamping grippers.

This construction of the clamping gripper device permits, in a simple manner, the adjustment of each clamping gripper, because the adjusting screw at the gripper housing can be located so that it is readily accessible. The opening and closing of the clamping grippers can therefore be adjusted so that they occur absolutely simultaneously. In addition, both gripper members of each clamping gripper are readily exchangeable due to their disposition.

In accordance with a further feature of the invention, the gripping shaft is rotatably mounted in the gripper tube, the second gripper members located at the inside of the periphery of the sheet turn-over cylinder being mounted spring-loaded and individually adjustable on the gripper tube, first control means located at one side of the press for controlling the gripper shaft, second control means located at the other side of the press for controlling the gripper tube, the common rotary axis of the gripper shaft and the gripper tube being substantially at the periphery of the sheet turn-over cylinder, the clamping grippers having substantially spherically shaped clamping surfaces, the sphericity of which varies with the location of the common rotary axis.

Mounting the gripper shaft in such a manner that the rotary axis thereof does not extend appreciably beyond the periphery line of the turn-over cylinder permits, in an advantageous manner, a strong and massive construction of the clamping grippers, the gripper shaft, the gripper tube and the bearings therefor. Excessively deep insertion into the channel of the adjacent cylinders does not occur. The cylinder periphery can therefore be utilized in the best possible manner through small dimensioning of the channel. It is a further advantageous consequence of the novel location of the rotary axis according to the invention that the pivot angle of the clamping grippers is kept relatively small. A further advantage thereof is that each clamping gripper is adjustable and individually spring-loaded. Due to this alone, an equal holding force is always ensured at all of the clamping grippers, an indispensable requirement for proper registration. The symmetrical distribution of the control means at both sides of the printing press furthermore results in a space-saving arrangement of all of the drive means.

In accordance with an added feature of the invention, the gripper tube is formed with recesses for the first gripper members located at the outside of the periphery of the sheet turn-over cylinder, the gripper housing, respectively, being formed with a recess, and the first gripper members extend through the respective recesses formed in the gripper tube and in the gripper housing, the first gripper members and the respective recesses formed in the gripper housing cooperating to provide lateral guidance for the gripper housing. This feature is distinguished by the fact that it offers an outstandingly simple and space-saving type of construction.

In accordance with an additional feature of the invention, the sheet turn-over device includes a drive member pivotally mounted on each end wall of the turn-over cylinder, the drive member being formed with a gear segment, an adjustable pin member carried by the drive member and having a roller thereon, cam means secured at a side wall of the press and engageable under spring pressure by the roller, the drive members at each end wall of said turn-over cylinder being disposed with mirror symmetry relative to one another, means including a gear respectively moving the drive members, the gear segments of the drive members respectively meshing with the gears for jointly controlling the drive members. Forced gripper control is thereby achieved as far as the closing is concerned. The use of form-locking control means ensures quiet running to the greatest extent possible even at high printing speeds, and secure closing of the grippers also in sheet runs of single-side printing.

In accordance with yet another feature of the invention, the cam means for drive members comprise respective adjacent pairs of cams mounted on the side walls of the press coaxially to the rotary axis of the sheet turn-over cylinder, the roller mounted on the pin member being axially displaceable selectively so as to engage one of the two cams of the adjacent pairs of cams.

In accordance with another feature of the invention, in the single-side printing position of the sheet turn-over device, the first gripper members secured to the gripper shaft have a clamping plane that is substantially always at the same level as that of the periphery of a transfer cylinder transferring a sheet to the sheet turn-over cylinder, regardless of the thickness of the sheet being transferred. A device for adjusting one of the gripper members of each gripper clamp to the thickness of the sheet to be printed thus becomes unnecessary. In addition, it is advantageous that the sheet will not become wavy during the transfer thereof between the gripper systems, but is guaranteed to lie flat. As is well-known, even the slightest waviness of the front or leading edge of a sheet during sheet transfer affects the registration of the printing in a very sensitive manner.

Whenever not enough holding force can be obtained with spherical clamping surfaces for some types of paper, such as smooth, heavy sheets, or cardboard that is smooth on both sides thereof, and when the rotary axis of the gripper shaft is situated in the vicinity of the periphery line of the turn-over cylinder, in accordance with a concomitant feature of the invention, the clamping grippers are comprised respectively of first and second cooperating gripper members, at least one of the members having a clamping surface that is planar and is provided with means to facilitate gripping action.

Thus, the clamping surfaces may, for example, be knurled or coated with corundum or diamond. Detrimental bending of the sheet edge can be largely avoided if plane clamping surfaces are used by averaging the deviation of the clamping surface from the tangent both in single-side sheet printing position as well as in the perfecting position in accordance with the different requirements regarding registration of both sheet transfer positions.

Other features which are considered as characteristic for the invention are set forth in the appended claims.

Although the invention is illustrated and described herein as embodied in sheet turn-over device for a first-form printing and perfecting press with clamping grippers, it is nevertheless not intended to be limited to the details shown, since various modifications may be made therein without departing from the spirit of the invention and within the scope and range of equivalents of the claims.

The invention, however, together with additionl objects and advantages thereof will be best understood from the following description when read in connection with the accompanying drawings, in which:

FIG. 5 is a partial cross section of the transfer cylinder or drum, the sheet turn-over cylinder and the impression cylinder with mounting or bearings;

FIG. 11 is a diagrammatic elevational view of part of a gripper having spherical clamping surfaces.

FIG. 12 is an elevational view similar to that of FIG. 11 of part of a gripper having planar clamping surfaces.

Figure 4:
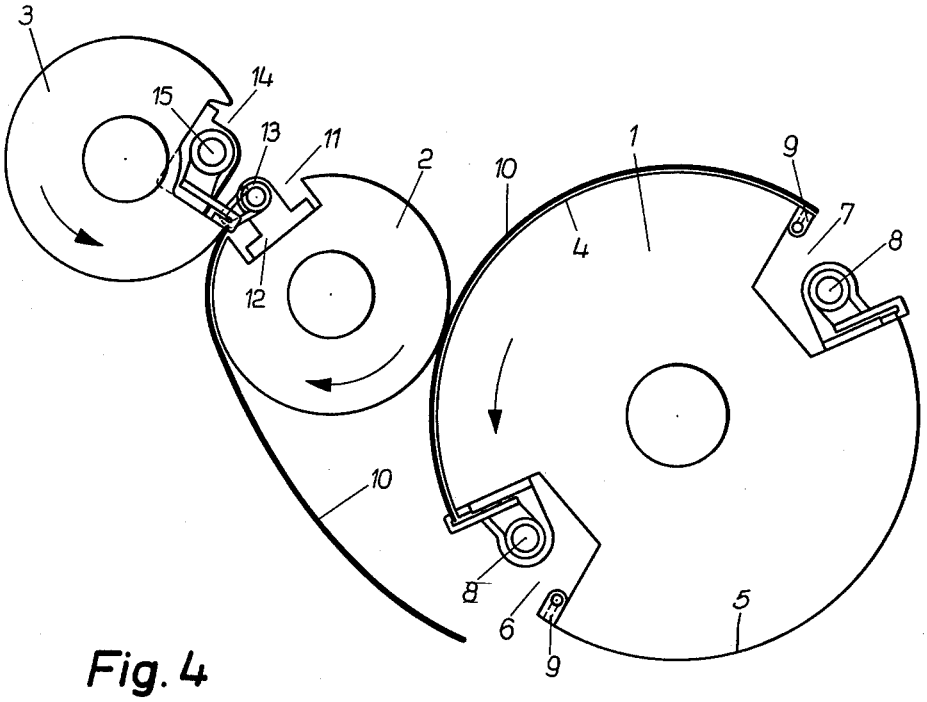
FIG. 4 is a diagrammatic elevational view of the three cylinders of the sheet turn-over device of the invention during sheet transfer between the sheet turn-over cylinder and the succeeding impression cylinder.

Referring now to the drawing and first, particularly to FIG. 4 thereof, there is shown the sheet turn-over device according to the invention, which includes a transfer drum or cylinder 1 and a turn-over cylinder 2, the latter being located between the transfer drum and the succeeding impression cylinder 3 of the printing unit or mechanism. The other cylinders of the printing mechanisms, between which the sheet turn-over device of the invention is provided, are not shown. Similarly, for reasons of clarity, another transfer cylinder, which must be located between the preceding printing unit or mechanism and the transfer cylinder 1 has been omitted from FIG. 4. Drum 1 has two sheet supporting surfaces 4 and 5, which are separated one from the other by two diametrically opposed cylinder channels 6 and 7. Grippers 8 are located, respectively, at one of the walls of each cylinder channel 6 and 7. At the cylinder channel wall opposite thereto, a suction bar 9 extends along the entire width of the cylinder 1. At the sheet supporting surface 4 of the transfer cylinder 1 there is located a sheet 10 that has been imprinted on one side thereof, the leading or forward edge of the sheet 10 being held by the grippers 8, and the rear or trailing end of the sheet 10 by the suction bar 9.

Since the sheet turn-over cylinder 2 has only half the diameter of the transfer drum 1, it has only one cylinder channel 11, in which bearings 12 for clamping grippers 13 are mounted. In a single channel 14 formed in the impression cylinder 3, grippers 15 are similarly provided.

As shown in FIG. 5, the cylinders 1 to 3 of the sheet turn-over device are supported or mounted in the side-walls 16 and 17 of the printing press; specifically, the sheet turn-over cylinder 2 is mounted by shaft journals 18 and 19 and the impression cylinder 3 by shaft journals 20 and 21. The sheet turn-over drum 2 is driven by a drive gear 22, which is mounted on the non-illustrated shaft of the transfer drum 1. The drive gear 22 meshes with a spur gear 23 which is adjustably mounted on the shaft journal 18 and which is adjacent a drive gear 24 of equal size mounted on the same shaft journal 18 of the sheet turn-over cylinder 2. The drive gear 24, in turn, meshes with a spur gear 25 which is firmly keyed on the shaft journal 20 of the impression cylinder 3.

Between one end wall 26 of the sheet turn-over cylinder 2 and the side wall 16 on the drive side of the printing press, there is a drive member 27 for the clamping grippers 13. The drive member 27 is rotatably supported on a pin 28 which is threadedly secured or screwed into the end wall 26. A corresponding drive member 30 for the clamping grippers 13 is located on the operator's side of the printing press between the other end wall 29 of the sheet turn-over cylinder 2 and the side wall 17. The drive member 30 is also pivotally mounted or a pin 28 screwed into the end wall 29. Both drive members 27 and 30 surround the shaft journals 18 and 19, respectively, of the sheet turn-over cylinder 2.

The construction of the drive members 27 and 30 can be seen in detail in FIGS. 1 to 8. Each of the drive members 27 and 30 has a gear segment 31 and 32, respectively, located at the respective ends thereof opposite the pin 28.

Figure 1:
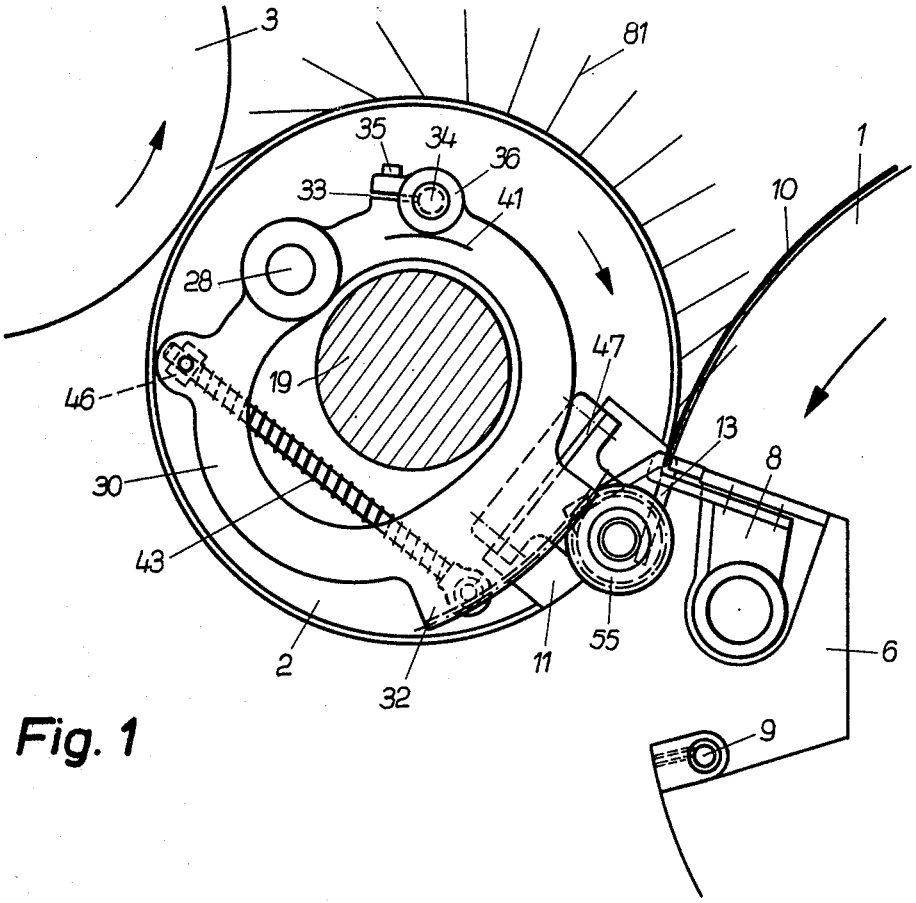
FIG. 1 is an elevational view, partly in section, of the sheet turn-over device according to the invention, at the operator's side, in the single-side sheet printing position thereof, as seen from the operator's side.
Figure 2:
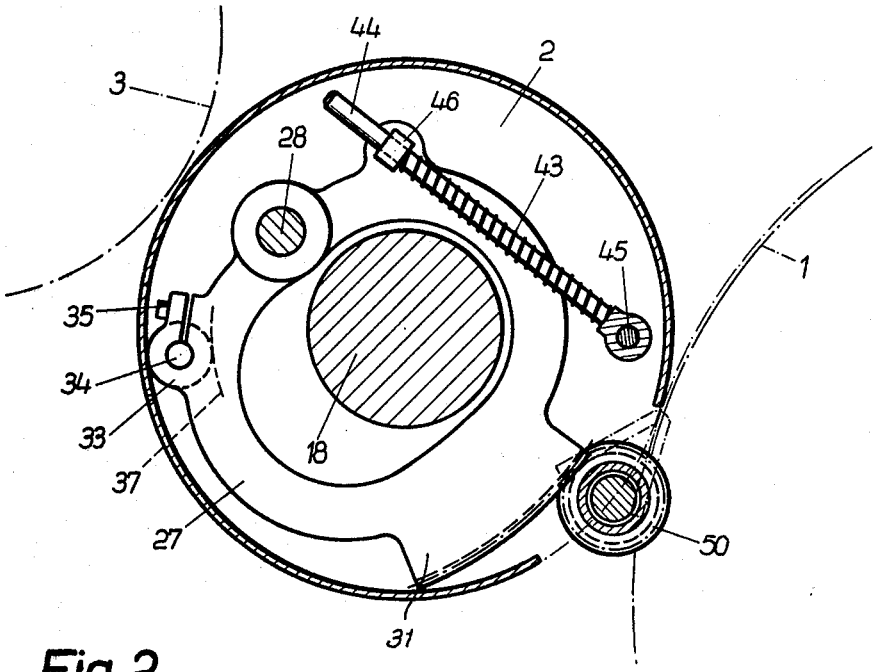
FIG. 2 is a view similar to that of FIG. 1 of the sheet turn-over device in the same operating position but at the drive side of the printing press, also as seen from the operator's side.
Figure 3:
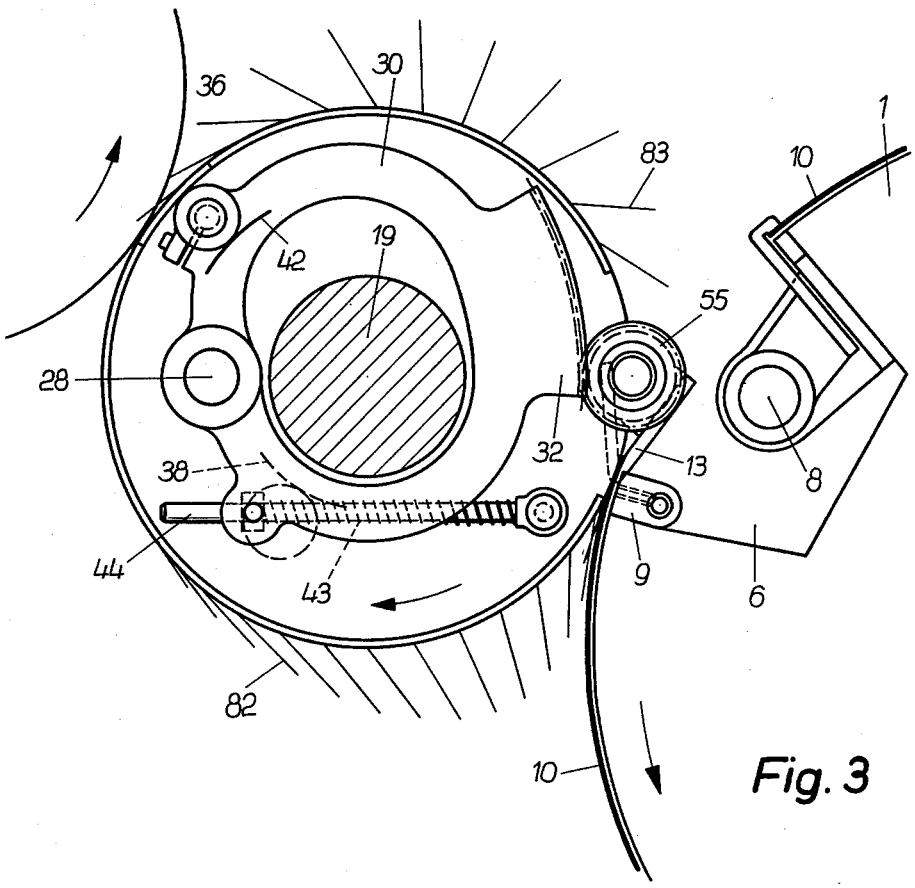
FIG. 3 is a view similar to those of FIGS. 1 and 2 of the sheet turn-over device in transfer position "perfecting" of the clamping grippers.

As can be readily noted from FIGS. 1 and 2, for example, a slotted journal bearing 33, in which a pin 34 is disposed so that it can be clamped by means of a clamping or set screw 35, is provided in the drive member 27 (FIG. 2) below the pin 28. A roller 36 is rotatably mounted on the pin 34, as can be seen in greater detail in FIG. 6. The roller 36 is selectively cooperable with two cams 37 and 38 by axially displacing the pin 34 in the journal bearing 33. Both of the cams 37 and 38 are mounted on the inside of the side wall 16 coaxially with the sheet turn-over drum 2. A snap ring 39 provided on the bearing pin 34 limits the axial displaceability of the pin 34 in the one direction, and the roller 36 per se in the opposite direction. If the cam roller 36 is located on the cam 38, the end of the bearing pin 34 provided with the snap ring 39 projects into a recess 40, which is machined into the end wall 26 of the sheet turn-over cylinder 2.

On the operator's side of the printing press, similar control means are provided. The slotted journal bearing 33 for the pin 34 of the roller 36, however, is not located here below, but rather above the pin 28, because the drive member 27 is located at the other side of the cylinder 2. Between the side wall 17 and the drive member 30 there are similarly fastened to the side wall 17, two cams 41 and 42 coaxially to the sheet turn-over cylinder 2. The cam roller 36 can be brought into engagement with one of the two cams 41 and 42 by axial displacement in the journal bearing 33 after the clamping screw 35 has been loosened. The snap ring 39, in that case, limits the axial displacement of the bearing pin 34 in the one direction. A recess 40 formed in the end wall 29 of the sheet turn-over cylinder 2 again serves for receiving the snap-ring 39 surmounted end of the pin 34 on which the roller 36 is mounted.

A respective compression spring 43 each acts upon the drive members 27 and 30 in such a manner that the respective roller 36 thereof is always pressed against the cams 37 or 38, on the one hand, and 41 or 42, on the other hand. The compression spring 43 is slipped over a spring rod 44 and, with one end thereof, through the eye of the spring rod 44, abuts against a pin 45 which is screwed into the end walls 26 and 29, respectively, of the sheet turn-over cylinder 2, while the other end of the compression spring 43 engages a stop or abutment 46 which is fastened to the drive member 27 and 30, respectively.

Figure 6:
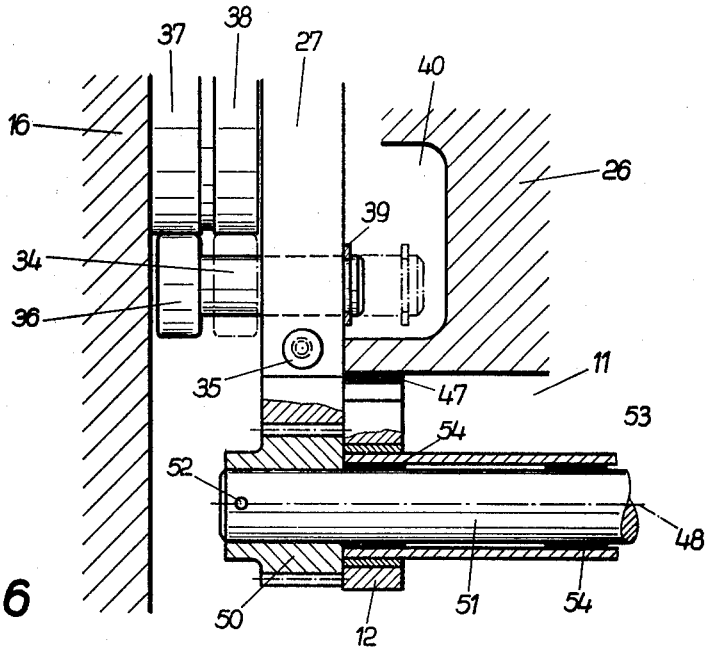
FIG. 6 is a fragmentary sectional view of a printing press showing control means for the grippers of the clamping grippers at the drive side of the printing press.
Figure 7:
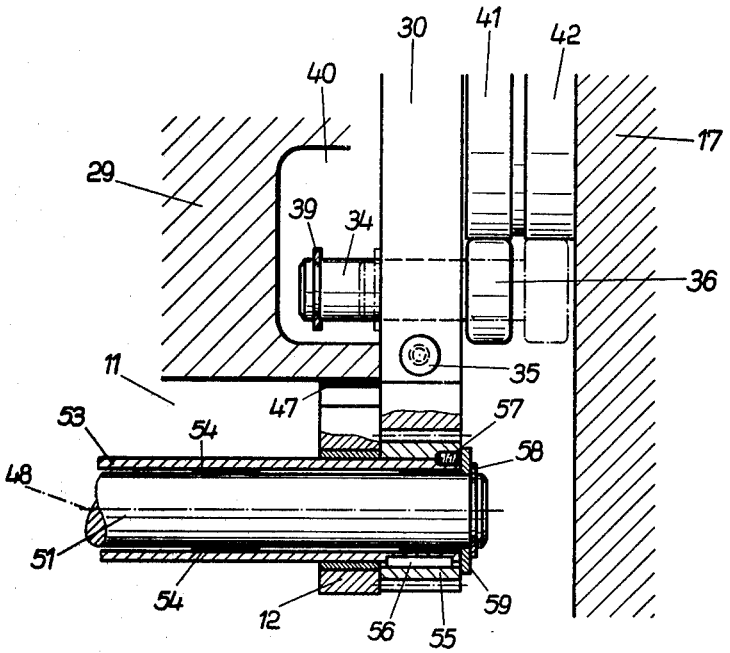
FIG. 7 is another fragmentary sectional view of a printing press showing corresponding control means for the opposing clamping grippers at the operator's side of the printing press.

The gear segment 31 of the drive member 27, as shown in FIG. 6, meshes with a gear 50, which is securely connected to a gripper shaft 51 through a tapered pin 52. The gripper shaft 51 extends coaxially through a gripper tube 53 and is rotatably supported in the latter by several bearings 54, as may be seen in detail in FIGS. 6 and 7. The gripper tube 53 extends along the channel 11 of the sheet turn-over cylinder 2 and is rotatably supported in the hereinafore-mentioned bearings 12. On the operator's side, there is located at the free end of the gripper tube 53, a gear 55 which meshes with the gear segment 32 of the drive member 30 and, with respect to the pitch diameter and the number of teeth, corresponds completely to the hereinafore-mentioned gear 50. The gear 55 is firmly connected, by means of a key 56 and a set screw 57, to the gripper tube 53. Axial guidance of the gripper shaft 51 in the gripper tube 53 is taken over, at one end of the gripper shaft 51, by the gear 50 and at the other end by a snap ring 58 in cooperation with a washer 59. Play or backlash between the gear segment 31 and the gear 50, on the one hand, and between the gear segment 32 and the gear 55, on the other hand, can be adjusted by inserting different shims 47 under the bearings 12.

Figure 8:
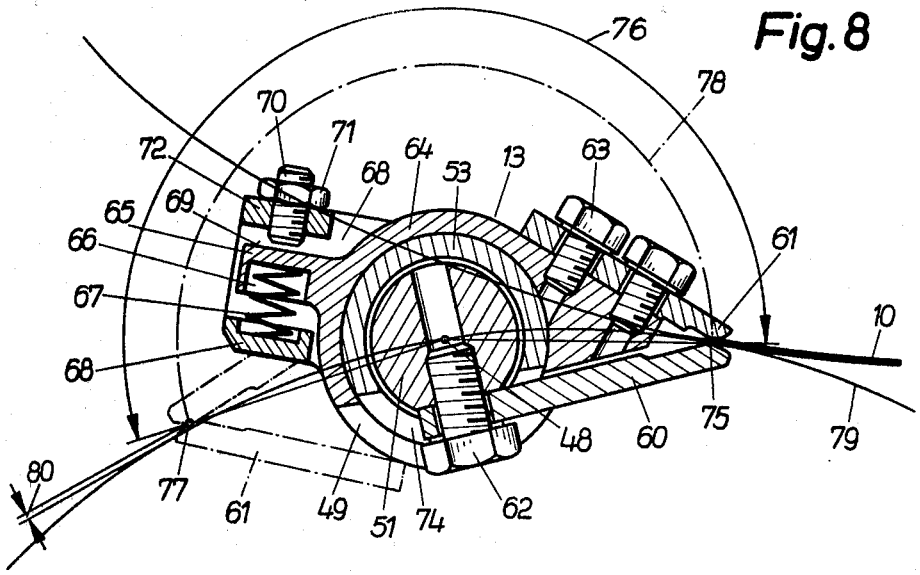
FIG. 8 is a sectional view of a clamping gripper according to the invention in perfecting position.
Figure 9:
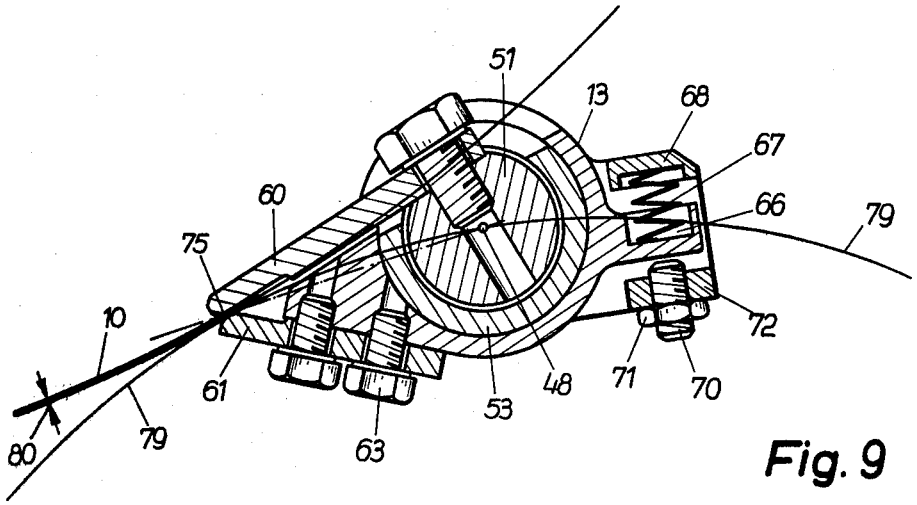
FIG. 9 is a sectional view similar to that of FIG. 8 of the same clamping gripper in the single-side sheet printing position.
Figure 10:
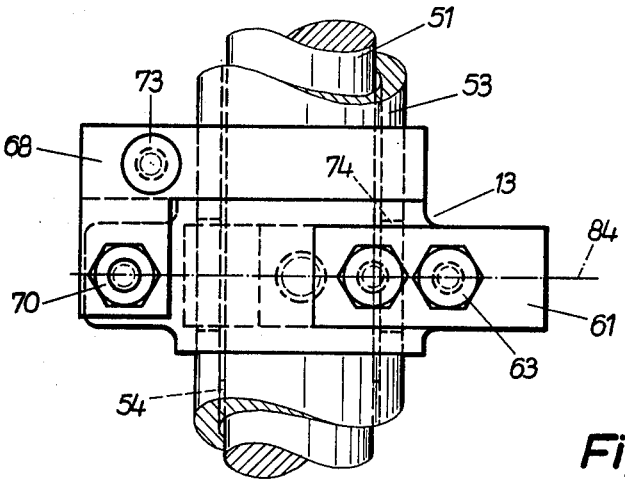
FIG. 10 is a top plan view of a clamping gripper according to the invention in perfecting position.

FIGS. 8 to 10 show in detail the construction of the clamping grippers 13. Each clamping gripper 13 is formed of a gripper member 60 and opposing gripper member 61; although referred to distinctively as gripper member and opposing gripper member, nothing is said regarding differing function or the necessary correlation of the clamping parts to the gripper shaft or the gripper tube. The inner gripper member is called the "opposing gripper member" only in order to distinguish the gripper member which is the outer one in the single-side sheet printing position from the inner one.

The gripper member 60 is fastened at the gripper shaft 51 by a screw 62, while the opposing gripper 61 is firmly connected by two screws 63 with a gripper housing 64, which is rotatably mounted on the gripper tube 53. Both the gripper members 60 as well as the opposing gripper members 61 are thus pivotable about the common rotary axis 48 of the gripper shaft 51 and the gripper tube 53. At the side of the gripper housing 64 which faces away from the opposing gripper member 61, there is a support arm 65 which is formed with a bore or recess 66 in which one end of a compression spring 67 is braced, the other end thereof being in pressing engagement with a stop 68. The side of the support arm 65 facing away from the recess 66 serves as a contact or abutment surface 69 for an adjusting or set screw 70, which can be firmly tightened by a lock nut 71 in a tapped bore 72 formed in the stop 68. By means of a clamping screw 73, the stop 68 is clamped on the gripper tube 53, as shown in FIG. 10. The gripper member 60 firmly connected to the gripper shaft 51 each protrude through a recess 74 formed in the gripper tube 53 and a further recess 49 formed in the gripper housing 64. Lateral guidance of the rotatably disposed gripper housings 64 is thereby affected by the fixed gripper members 60 with the aid of the respective lateral edges defining the recess 49.

The adjusting or set screw 70 is given a very specific adjustment dimension, i.e. the end thereof facing the stop or abutment surface 69 is spaced a quite definite distance from the latter, so that the instant at which all of the clamping grippers 13 open is the same. The compression springs 67 and their supports or bearings are all of the same construction so that they produce the same holding or retaining force at all clamping surfaces 75 of the gripper members 60 and the opposing gripper members 61 through the rotatably mounted bearing housing 64. As shown in FIG. 8, the clamping grippers 13 are pivotable through an angle 76 from the perfecting position in FIG. 8 into the single-side sheet printing position of FIG. 9. The clamping line 77 of the clamping surfaces 75 thus describes the path traversed as indicated by the dash-dot line 78. The clamping surfaces 75 in the embodiment of FIGS. 8, 9 and 11 are spherical. Because, however, in the embodiment of the turn-over device of the invention shown in FIGS. 8 and 9 the rotary axis 49 of the gripper shaft 51 and the gripper tube 53 lies exactly on the peripheral line 79 of the sheet turn-over cylinder 2, the sphericity need be only relatively slight in order to avoid bending the gripped sheet. The clamping surfaces 75, the fastening of the gripper member 60, the support or bearing of the gripper housing 64 as well as the stop or abutment surface 69 and the compression spring 67 are disposed symmetrically to the longitudinal axis 84 of the clamping grippers 13.

In the perfecting position of the clamping gripper 18, the clamping surfaces 75 or all the gripper members 60 are exactly at the height or level of the peripheral line 79 of the sheet turn-over cylinder. The spring-loaded opposing gripper member 61, on the other hand, accommodates itself to the thickness of the transferred sheet 10 because of the springiness or resilience thereof. In the single-side or first-form printing position of the clamping grippers 13 according to FIG. 9, on the other hand, the clamping surfaces 75 of the fixed gripper members 60 are exactly at the height or level of the peripheral line of the transfercylinder 1. In this manner, transfer of a sheet formed with a wavy front edge is prevented. Also, in this position, the spring-loaded opposing gripper member 61 accommodates itself to the thickness 80 of the transferred sheet 10. It is thereby made unnecessary to adjust the fixed gripper to the thickness of the sheet in each case.

In the case where relatively heavy, extremely smooth sheets 10 or cardboard smooth on both sides thereof are to be transported by the clamping grippers 13, it may be that a stronger clamping force is indicated in order to ensure sheet transfer without loss of registration. In that case, either the fixed gripper members 60 or the spring-loaded opposing gripper members 61 can be exchanged for corresponding members having a flat or planar gripping chamber surface 75 as seen on members 61' in FIG. 12. In many cases, it will be sufficient merely to replace either the fixed gripper members 60 alone or the spring-loaded opposing gripper members 61 alone. In difficult cases, however, there is also the possibility of employing for both the fixed gripper member 60 as well as the spring-loaded opposing gripper members 61 corresponding members having flat or planar gripping surfaces which may be knurled or coated with corundum, for example. This construction is specifically necessary because, if the rotary axis 78 is located on the peripheral line 79 of the sheet turn-over cylinder 2, the clamping surfaces in the single-side or first-form printing position can be oriented so that the bending angle of the accepted sheet turns out to be negligibly small. However, a somewhat larger bending angle must then be taken into consideration in the perfecting position of the clamping grippers 13, but this does not effect a registered sheet transfer so detrimentally because, in the perfecting position, the rear or trailing edge of the sheet is gripped, the sheet itself being held at its front edge in registration, however, until the transfer has taken place.

The hereinbefore described sheet turn-over device of the invention operates as follows: For first-form or single-side printing runs of the sheet 10 according to FIGS. 1 and 2, the sheet 10 is transported by the grippers 8 of the transfer cylinder 1 and transferred at the tangential point between the transfer cylinder 1 and the sheet turn-over cylinder 2 to the gripper clamps 13, which then remain in the position shown in FIG. 1 until the sheet 10 is transferred to the grippers 15 of the impression cylinder. This transfer also occurs in a conventional manner at the tangential point between the sheet turn-over cylinder 2 and the impression cylinder 3. Immediately after the transfer has occurred, the gripper members 60 as well as the opposing gripper members 61 are swung or pivoted about the rotary axis 48 in such a manner that the front or leading edge of the sheet is freed. During the following further rotation of the sheet turn-over cylinder 2, the fixed gripper member 60 pivots or swings in accordance with the vectors 61 and is thereby moved under the front or leading edge of a new sheet 10 which is advanced by the transfer cylinder 1. Accordingly, the clamping surfaces 75 thereof are situated exactly at the height or level of the peripheral line of the transfer cylinder 1 at the instant the sheet is transferred.

The cams 37 and 41, in common, effect the combined pivoting, opening and closing motion of the clamping grippers 13. On the drive side, the gripper members 60, which are firmly connected to the gripper shaft 51, are driven through the roller 36, the drive element 27, the gear segment 31 and the gear 50. On the operator's side, the roller 36, drive element 30, gear segment 32 and gear 55 analogously effect the control of the opposing gripper members 61, which are resiliently applied to the gripper tube 53. The force for opening the clamping grippers 13 is thus applied by the compression springs 43 which, in addition, have the purpose, as already explained hereinabove, of keeping the rollers 36 in contact with the cams 37, 38, 41 and 42.

If the device according to the invention is to be set for one-side or first-form printing and perfecting, it is necessary only to shift the rollers 36 axially on the drive side and the operator's side. For this purpose, it is necessary to loosen the clamping screws 35 and to shift the rollers 36 from the cam 37 to the cam 38 on the drive side. Similarly, on the operator's side, the roller 36 is moved outwardly away from the cam 41 until it engages the cam 42. After the shifting adjustment, the clamping screws 35 must be re-tightened. During the subsequent operation of the printing press, in which the sheet turn-over device according to the invention is installed, the clamping grippers 13 move in accordance with the vectors 82 and 83 indicated in FIG. 3 at the periphery of the sheet turn-over cylinder 2.

The transfer cylinder 1 again feeds the sheets 10 to the sheet turn-over cylinder 2. During this operation, the sheets 10 are held, at least beginning from the position of the transfer cylinder 1 according to FIG. 4, by the grippers 8 at the front or leading edge as well as by the suction bar 9 at the end or trailing edge of the sheets. The front or leading edge of the sheet 10 is conducted by the grippers 8 past the sheet turn-over cylinder 2 until the channel 6 or 7 of the transfer cylinder 1 is located opposite the channel 11 of the sheet turn-over cylinder 2. In this position of the cylinders 1 and 2, the clamping grippers 13, as may be seen in FIG. 3, grip the rear or trailing edge of the sheet 10 immediately behind the suction bar 9. This transfer position is also shown in FIG. 8 on an enlarged scale. After the rear or trailing edge of the sheet 10 has been taken over by the clamping grippers 13, the suction bar 9 first releases the sheet 10 and only then do the grippers 8 of the transfer cylinder 1 open. During the subsequent further rotation of the sheet turn-over cylinder 2, the clamping grippers 13 execute a swinging or pivoting motion about the axis of rotation 48 in accordance with the vectors 82, until they meet with the grippers 15 at the point of tangency between the sheet turn-over cylinder 2 and the impression cylinder 3. Shortly before reaching this position, the clamping grippers 13 find themselves exactly in the first-form or single-side position again. They transfer the sheet 10 to the grippers 15 of the impression cylinder 3 in proper registration. After the transfer, the clamping grippers 13 execute a swinging or pivoting motion about the axis of rotation 48 in accordance with the vectors 83, until they have again reached the perfecting position, and grip the rear or trailing edge of the next sheet 10 advanced by the transfer cylinder 1.

Through the control of the clamping grippers 13, previously explained herein in connection with the first-form or single-side printing run of the sheets, the closing of the grippers 13 remains under forced control also during the turn-over of the sheets, a uniform holding force of the clamping grippers 13 being assured during all phases of operation of the sheet turn-over device.

It is claimed:

1. Sheet-turn over device for a one-side printing and perfecting press with clamping grippers pivotable about a rotary axis and mounted in a sheet turn-over cylinder so as to be adjustable from single-side printing to one-side printing and perfecting comprising a gripper shaft coextensive with the rotary axis about which the clamping grippers are pivotable, a gripper tube coaxially disposed on said gripper shaft, and separate control means for respectively driving said gripper shaft and said gripper tube, the rotary axis of said gripper shaft as well as of said gripper tube being disposed radially inwardly from a point on a tangent to the periphery of the sheet turn-over cylinder at the point of clamping contact of the grippers, and including respective gripper housings rotatably mounted on said gripper tube, said clamping grippers comprising respective first gripper members firmly secured to said gripper shaft, and respective second gripper members firmly secured to the respective gripper housing, a stop member firmly mounted on said gripper tube for each of said second gripper members, said first and second gripper members, in the single-side printing positions of the sheet turn-over device, being located at the outside and the inside respectively, of the periphery of the sheet turn-over cylinder, adjustable limit means spaced from said stop member, said gripper housing respectively being rotatable in direction toward said stop against the biasing action of a compressive spring for closing said clamping grippers and being rotatable in direction toward said adjustable limit means for opening said clamping grippers.

2. Sheet turn-over device according to claim 1 wherein said gripper shaft is rotatably mounted in said gripper tube, said second gripper members located at the inside of the periphery of the sheet turn-over cylinder being mounted spring-loaded and individually adjustable on said gripper tube, first control means located at one side of the press for controlling said gripper shaft, second control means located at the other side of the press for controlling said gripper tube, the common rotary axis of said gripper shaft and said gripper tube being substantially at the periphery of the sheet turn-over cylinder, said clamping grippers having substantially spherically shaped clamping surfaces.

3. Sheet turn-over device according to claim 2 wherein said gripper tube is formed with recesses for said first gripper members located at the outside of the periphery of the sheet turn-over cylinder, said gripper housing, respectively, being formed with a recess, and said first gripper members extend through the respective recesses formed in said gripper tube and in said gripper housing, said first gripper members and said respective recesses formed in said gripper housing cooperating to provide lateral guidance for said gripper housing.

4. Sheet turn-over device according to claim 3 including a drive member pivotally mounted on each end wall of said turn-over cylinder, said drive member being formed with a gear segment, an adjustable pin member carried by said drive member and having a roller thereon, cam means secured at a side wall of the press and engageable under spring pressure by said roller, the drive members at each end wall of said turn-over cylinder being disposed with mirror symmetry relative to one another, means including a gear respectively moving said drive members, said gear segments of said drive members respectively meshing with said gears for jointly controlling said drive members.

5. Sheet turn-over device according to claim 4 wherein said cam means for said drive members comprise respective adjacent pairs of cams mounted on the side walls of the press coaxially to the rotary axis of said sheet turn-over cylinder, said roller mounted on said pin member being axially displaceable selectively so as to engage one of the two cams of said adjacent pairs of cams.

6. Sheet turn-over device according to claim 5, in the singleside printing position of the sheet turn-over device, said first gripper members secured to said gripper shaft have a clamping plane that is substantially always at the same level as that of the periphery of a transfer cylinder transferring a sheet to said sheet turn-over cylinder, regardless of the thickness of the sheet being transferred.

7. Sheet turn-over device according to claim wherein at least one of said gripper members has a clamping surface that is planar and is provided with means to facilitate gripping action.

* * * * *